US006254952B1

(12) United States Patent
Fox et al.

(10) Patent No.: US 6,254,952 B1
(45) Date of Patent: Jul. 3, 2001

(54) STRIP TIED LABEL SHEET

(75) Inventors: David A. Fox, Newport Beach, CA (US); Timothy W. Rawlings, Waynesville; Michael E. Hetrick, Dayton, both of OH (US)

(73) Assignee: NCR Corporation

( * ) Notice: Subject to any disclaimer, the term of this patent is extended or adjusted under 35 U.S.C. 154(b) by 0 days.

(21) Appl. No.: 09/259,116

(22) Filed: Feb. 26, 1999

(51) Int. Cl.[7] ..... B42D 15/00

(52) U.S. Cl. ..... 428/40.1; 283/67; 283/81; 283/105; 283/900; 428/42.1; 428/42.2; 428/42.3; 428/43; 428/138; 428/220

(58) Field of Search ..... 428/40.1, 43, 42.1, 428/42.2, 42.3, 138, 220; 283/81, 67, 105, 900

(56) References Cited

U.S. PATENT DOCUMENTS

| | | | |
|---|---|---|---|
| 3,993,814 | 11/1976 | Cavender | 428/40.1 |
| 5,031,939 | 7/1991 | Webendorfer et al. | 283/81 |
| 5,147,699 | 9/1992 | Browning et al. | 428/40.1 |
| 5,328,208 | 7/1994 | Garrison | 283/105 |
| 5,642,906 | 7/1997 | Foote et al. | 283/67 |
| 5,855,395 | 1/1999 | Foote et al. | 283/67 |

FOREIGN PATENT DOCUMENTS 2225766 6/1990 (GB) .

OTHER PUBLICATIONS

Various samples of labels/forms produced by NCR Corporation, Dayton, OH before or during the mid–90's.
Costco Pharmacy form, Rev. 11/98.

*Primary Examiner*—Nasser Ahmad
(74) *Attorney, Agent, or Firm*—Francis L. Conte

(57) ABSTRACT

A label sheet includes a release liner having a leading edge for first traveling through a printer. An overlay is adhesively bonded to the liner. The overlay includes a feed strip extending laterally across the liner adjacent the leading edge thereof. A narrow label and a wide label are disposed laterally along the feed strip at corresponding die cuts for permitting individual removal thereof. The die cut at the leading edge of the narrow label has an interrupting tie therein for locally joining the narrow label to the feed strip, with the wide label having a continuous die cut at its leading edge without interruption.

12 Claims, 5 Drawing Sheets

STRIP TIED LABEL SHEET

BACKGROUND OF THE INVENTION

The present invention relates generally to pressure sensitive label sheets, and, more specifically, to printed label sheets.

Pressure sensitive labels are commonly available in various forms. In a typical embodiment, a label sheet includes several individually removable labels which define an overlay or face sheet adhesively bonded to a release liner. The adhesive is permanently bonded to the back of the overlay, and forms a weak bond with the liner which typically has an exposed silicone surface permitting individual label removal therefrom.

The individual labels are typically defined by full perimeter die cuts which completely sever adjoining labels from their neighbors atop the continuous liner. By lifting the edge of an individual label, the label may be readily peeled away from the liner independently of adjacent labels, with the so removed label then being reattached to another surface using the same adhesive carried on the back of the label for effecting a bond therewith, which is typically permanent.

The adhesive must be suitably tailored in strength for maintaining integrity of the entire label sheet to prevent premature delamination of any of the individual labels thereon, while also permitting individual removal of the labels, with the perimeter die cuts preventing simultaneous multiple label removal.

However, if it is desired to simultaneously remove two or more labels together, the die cuts therebetween may be interrupted by corresponding ties which maintain the continuity of the overlay from label to label without interruption. Several such ties may be spaced apart around the perimeter of adjoining labels so that removal of one label carries with it the so tied adjoining label in a serial strip of labels. The so removed individual labels may then be separated from each other by severing or tearing the joining ties.

In use, labels are printed for various reasons. For example, a pharmacy script is a specialized label sheet having differently sized and configured individual labels for different objectives. Relatively large labels may be used for identifying dispensed drugs and corresponding use instructions. Smaller labels may contain various warnings. And, an associated paper form integrated with the label sheet may include various information regarding the nature of the drug being dispensed and various instructions and warnings.

Pharmacy scripts are available in different configurations for various reasons. The primary objective of the pharmacy script is the labeling of prescription drug containers in a highly competitive industry. Since a typical pharmacy or drugstore dispenses a considerable volume of drug prescriptions each day, the pharmacy script must be easy and fast to use.

In one recently developed pharmacy script, several wide and narrow labels are formed laterally along a thin strip at the leading edge of the label sheet. The leading edge strip defines the feeding direction for the sheet and its orientation so that various information may be printed atop the various labels of the label sheet in the same configuration as multiple sheets are fed through a printer, such as a typical laser printer. In an initial prototype, the various labels contained full perimeter die cuts to ensure the individual removal thereof when desired. The individual labels must be readily removable without delay or damage to maximize the efficiency of label application to their containers.

However, during development and testing of this configuration, premature delamination of portions of the label sheet occurred during sheet transport through the printer. The discovery of this problem and the corresponding solution therefor are the subject of the present invention which prevents premature delamination of the label sheet, while maintaining both the specified configuration thereof including die cut perimeters of the individual labels.

BRIEF SUMMARY OF THE INVENTION

A label sheet includes a release liner having a leading edge for first traveling through a printer. An overlay is adhesively bonded to the liner. The overlay includes a feed strip extending laterally across the liner adjacent the leading edge thereof. A narrow label and a wide label are disposed laterally along the feed strip at corresponding die cuts for permitting individual removal thereof. The die cut at the leading edge of the narrow label has an interrupting tie therein for locally joining the narrow label to the feed strip, with the wide label having a continuous die cut at its leading edge without interruption.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
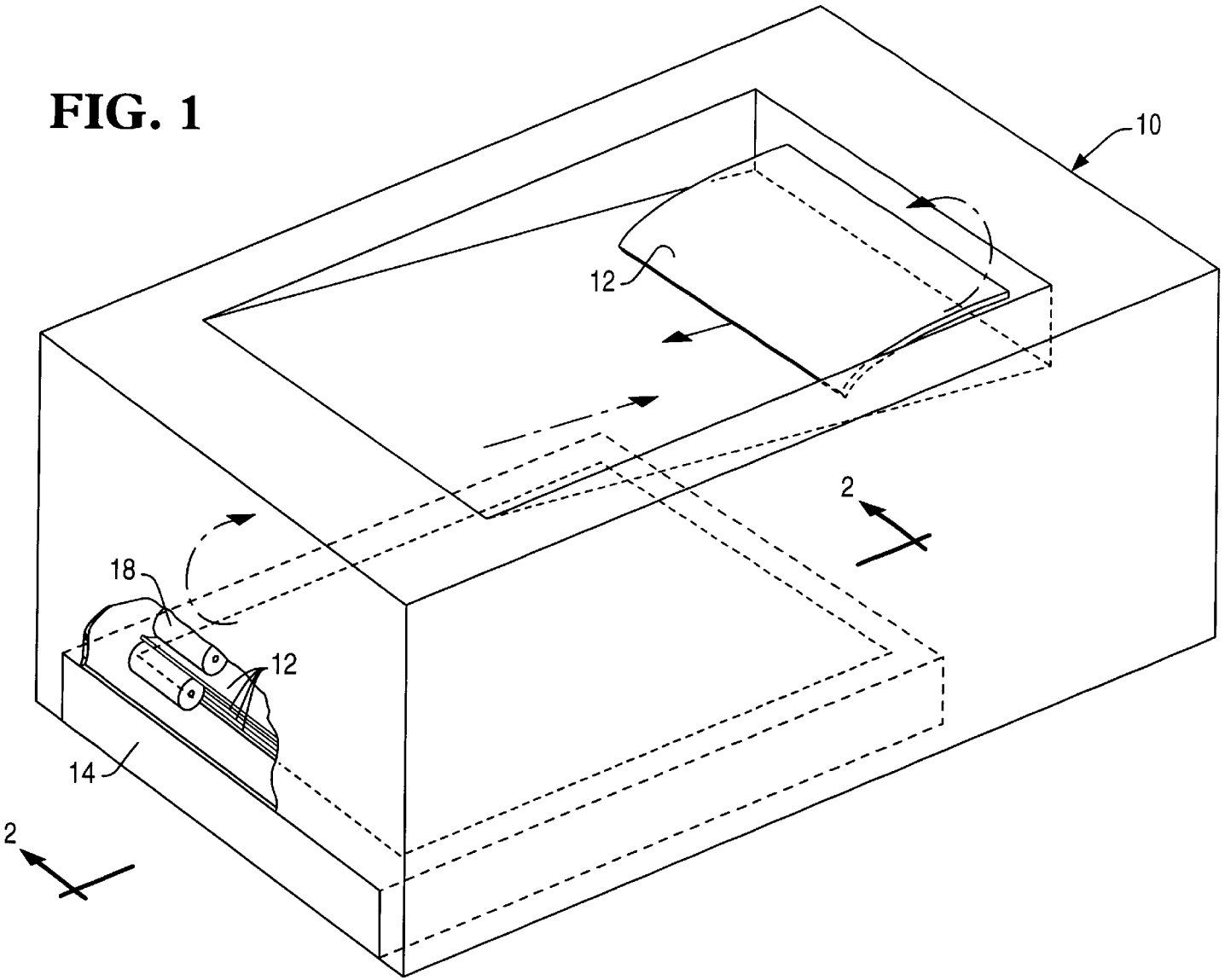
FIG. 1 is an isometric view of an exemplary laser printer through which label sheets may be carried in accordance with the present invention.

Illustrated in FIG. 1 is an exemplary laser printer 10 for use in printing label sheets 12 configured in accordance with the present invention. The printer 10 is conventional in configuration and may be in the form of an OptraS laser printer manufactured by Lexmark International, Lexington, Ky. The Lexmark OptraS printer is commercially available in various series or models including 1655 et seq.

Figure 2:
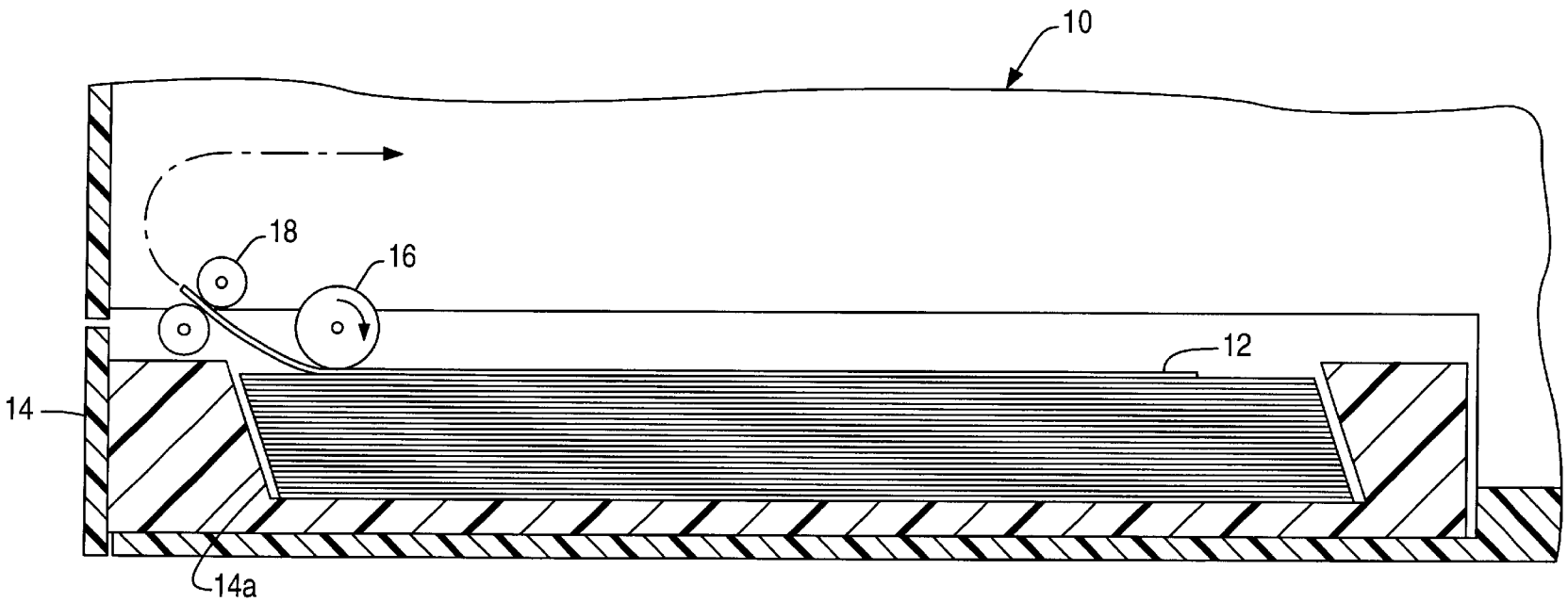
FIG. 2 is an elevational, sectional view through a portion of the laser printer illustrated in FIG. 1 and taken along line 2—2, having a feed tray including a stack of label sheets for being individually printed.

The printer 10 includes a front loading paper tray 14 which is readily removable for placing therein a stack of the label sheets 12 as illustrated in FIG. 2. The tray 14 includes a forward dam 14*a* which provides an inclined surface against which the sheets 12 may be stacked. In this way, the outermost sheet may be initially positioned slightly ahead of each succeeding sheet in turn for permitting individual feeding of the several sheets.

Suitably mounted inside the printer are a pair of laterally spaced apart pickup rollers 16 which frictionally engage the forward end of the top sheet 12 in the tray 14, as illustrated in FIG. 2, to launch the sheet through the paper path in the printer. A pair of feed rollers 18 are suitably mounted in the printer for immediately receiving the leading edge of the sheet from the pickup rollers for driving the sheet at the beginning of its path through the printer.

Figure 3:
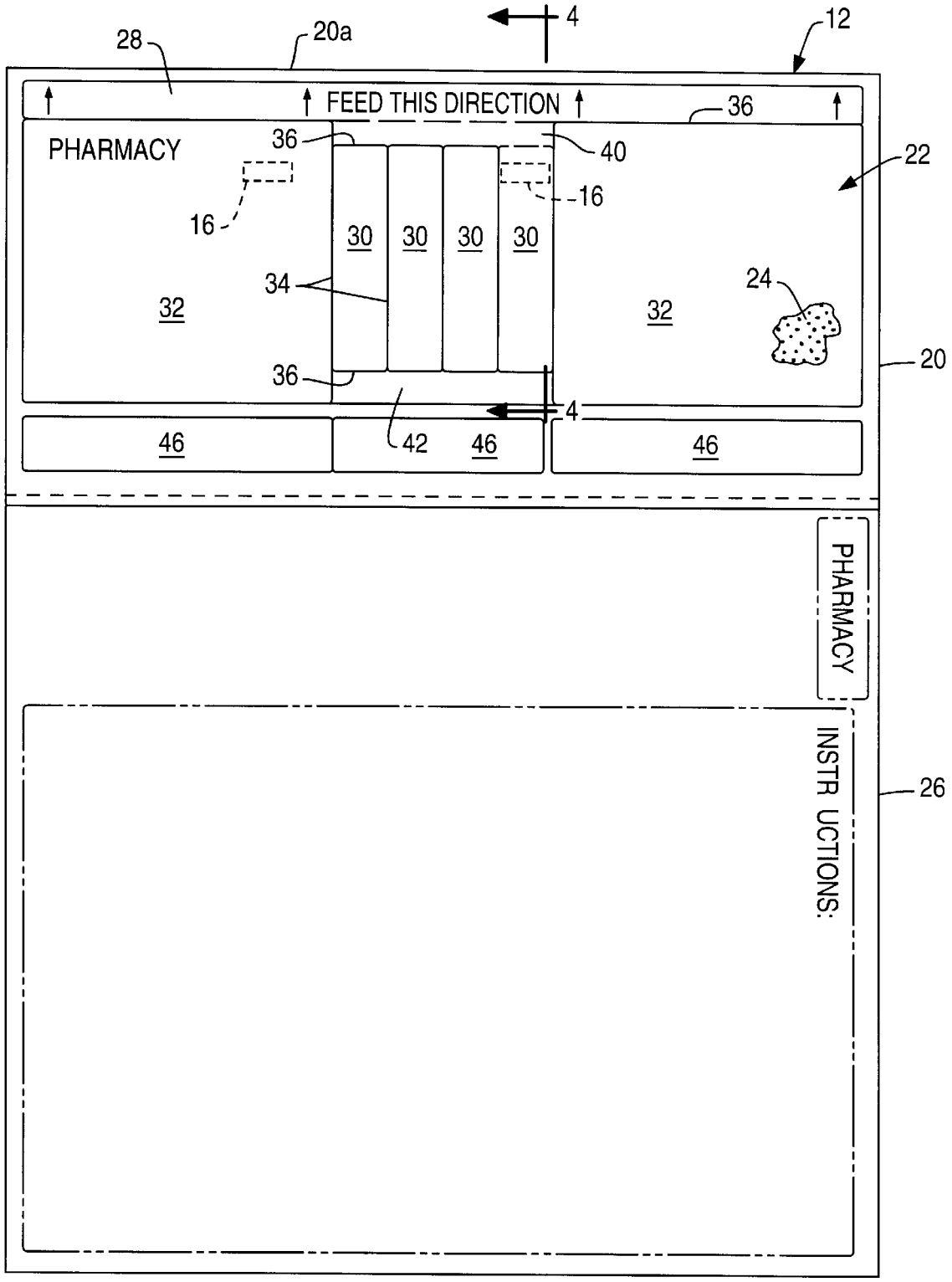
FIG. 3 is a top view of a label sheet configured in accordance with an exemplary embodiment of the present invention for travel through the laser printer illustrated in FIGS. 1 and 2.

An exemplary one of the label sheets 12 is illustrated in FIG. 3 in front view in the form of a specifically configured pharmacy script. The forward end of the label sheet is illustrated in more detail in FIG. 4.

The label sheet includes a release liner 20 which may have any conventional configuration and composition, and typically includes a silicone coated material having low adhesion capability. The liner 20 supports a face sheet or overlay 22 which is adhesively bonded thereto using a suitable adhesive 24 such as that typically used for pressure sensitive labels.

In the exemplary embodiment illustrated in FIG. 3, the label sheet 12 also includes an integrated paper form sheet 26 bonded to the liner 20 at a lap joint therebetween extending the full width of the sheet. The form sheet 26 may be configured for any useful purpose such as containing various printed information thereon for use in conducting a typical pharmaceutical prescription drug transaction.

Pharmacy scripts have enjoyed years of commercial use in this country, and have various conventional constructions and configurations, with multiple pressure sensitive labels attached to a liner integrated with an attached form sheet. The label sheet 12 illustrated in FIG. 3 is a new configuration having improved efficacy in completing prescription drug transactions.

More specifically, the release liner 20 illustrated in FIG. 3 has a leading edge 20*a* which first travels through the corresponding path inside the printer 10 illustrated in FIGS. 1 and 2. As used herein, leading edges are those edges which first travel along the feed path through the printer, with trailing edges being opposite edges along the travel or feed direction which last follow the corresponding leading edges through the printer.

With respect to FIG. 3, the liner leading edge 20*a* is disposed at the vertical top of the sheet and extends the full lateral or horizontal width therebetween. The trailing edge of the liner 20 overlaps and is suitably bonded to the leading edge of the form sheet 26, also along the entire width of the script. And, the form sheet 26 has a horizontal trailing edge which is disposed at the vertical bottom of the script.

The left and right side edges of the script extend vertically over its length, and define horizontally therebetween the width of the script. The script in the exemplary embodiment illustrated is rectangular, and is longer in length or height than it is wide. The exemplary rectangular script is 8.5 by 14 inches (21.6 cm by 35.6 cm) in height and width, respectively.

Referring again to FIG. 3, the label sheet includes a thin feed strip 28 which extends laterally across the liner 20 adjacent the leading edge 20*a* thereof. The thin feed strip 28 has a thickness or height of about 5 mm and extends substantially the full width of the liner. The feed strip 28, itself, has a leading edge slightly offset back from the leading edge of the liner by about 1 mm, for example, and also has a trailing edge.

The overlay 22 in the preferred embodiment illustrated in FIG. 3 has a plurality of laterally narrow labels 30 laterally adjoining each other, and which are laterally straddled by a pair of wide labels 32 extending laterally to the opposite left and right sides of the liner. The narrow labels 30 are about 12 mm wide, and relatively narrow compared to the wider labels 32 which are about 90 mm in width, for example. The narrow labels 30 are about 41 mm in length or height, as compared to the larger wide labels 32 which are 50 mm in height, for example.

Both the narrow and wide labels 30,32 laterally adjoin each other in turn along the length of the feed strip 28 over substantially the entire width of the liner. The feed strip and the labels are defined and severed from each other by corresponding die cuts including vertical die cuts 34 and horizontal die cuts 36. The die cuts 34,36 are conventionally formed using a sharp die blade which severs the overlay 22 down to but not including the underlying liner 22. The die cuts permit the individual removal of the labels from the liner by being peeled away therefrom, without adjoining labels being carried therewith. Each label must be separately removed for subsequent reattachment to another surface as desired using the same adhesive 24 coating the back sides thereof.

Figure 5:
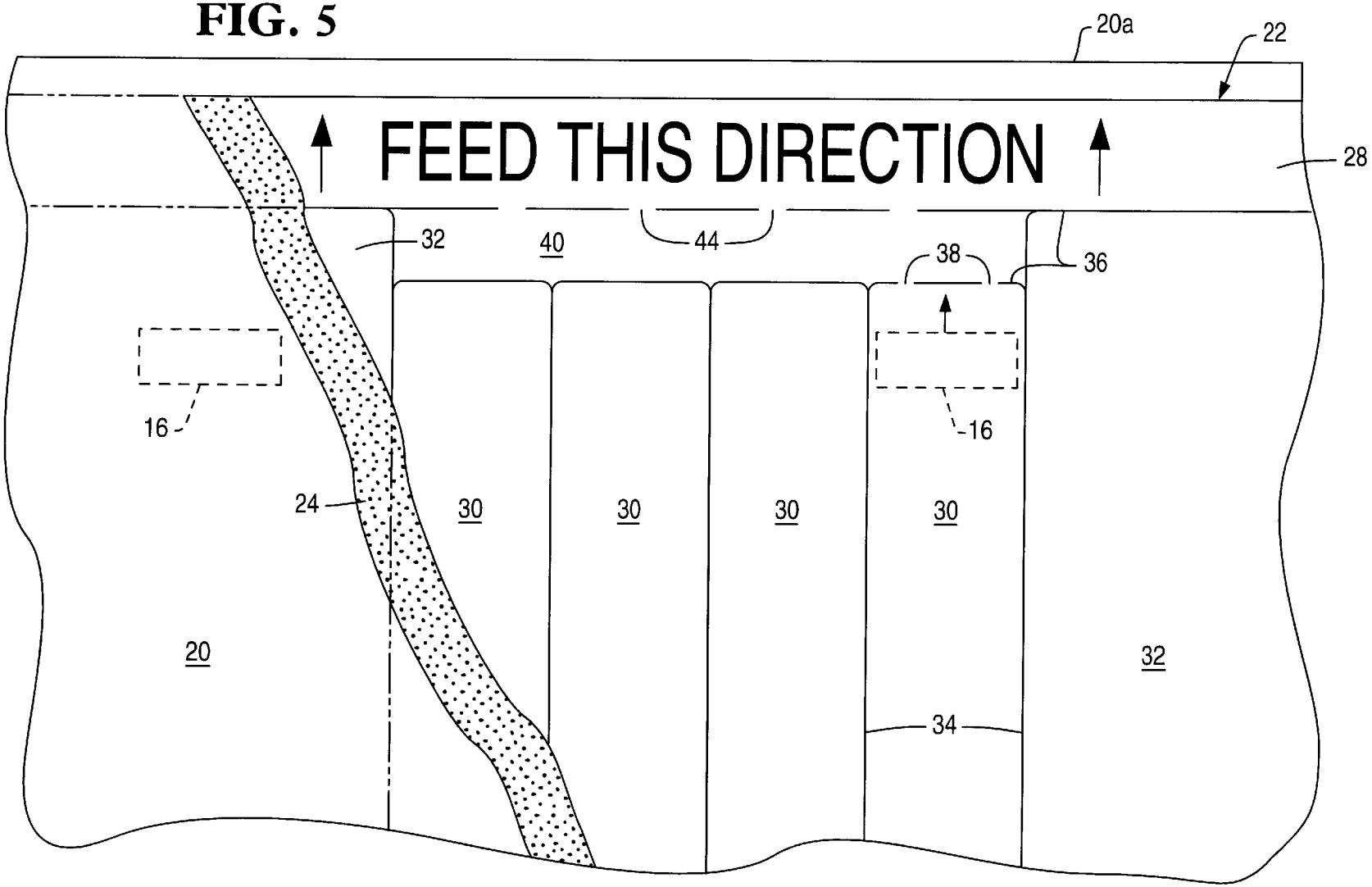
FIG. 5 is an enlarged view of the top center portion of the sheet illustrated in FIG. 3 in accordance with an exemplary embodiment.

FIG. 5 illustrates an enlarged view of the top center of the label sheet illustrated in FIG. 3. In the exemplary embodiment illustrated, there are four laterally adjoining narrow labels 30 straddled between the end two wide labels 32. The wide labels may be printed by the printer with any useful information regarding a typical prescription drug transaction such as an identification of the prescription and customer, and use instructions, with the labels being manually peeled from the liner 20 individually for reattachment around a prescription container (not shown) or packaging box. The four narrow labels 30 may have printed thereon additional information such as various warnings or use instructions, with each narrow label being individually removable for placement around the prescription container or its box.

The specific configuration of the pharmacy script illustrated in FIGS. 3 and 5 is controlled by its specific intended use. The script is a specialty configuration, having specially configured labels and form sheet. As a result thereof, the feed strip 28 contains a legend stating "FEED THIS DIRECTION" and corresponding arrows which point vertically upwardly along the height of the strip for ensuring the proper feeding of the script in the laser printer 10. The printer is software controlled by a corresponding computer which includes all the desired information being printed atop the script during a transaction.

During development testing of this specific form of script, the narrow labels 30 in conjunction with the thin feed strip 28 experienced premature delamination between the feed strip and the narrow labels upon travel through the printer. This premature delamination is undesirable since it not only damages the script itself, but may also cause portions of the liberated label overlay to adhere inside the printer causing jamming thereof which requires manual correction and prevents use of the printer during such time.

It has been discovered that the combination of the narrow labels and the thin feed strip along with the driving mechanism of the specific printer causes this problem.

Figure 4:
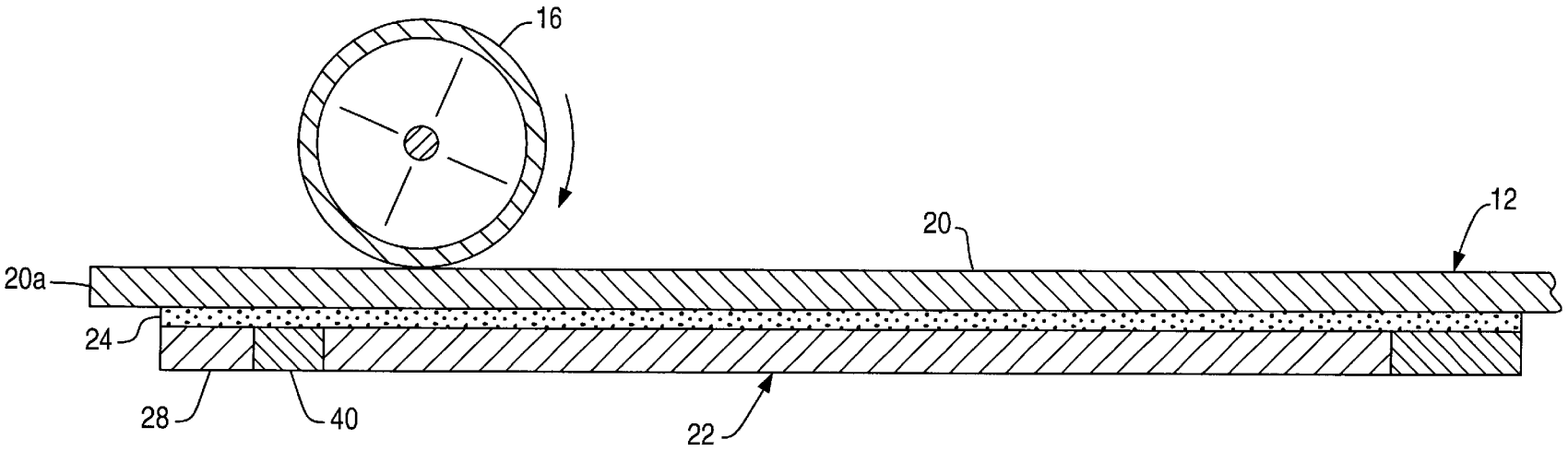
FIG. 4 is an enlarged, elevational sectional view through the forward portion of the label sheet illustrated in FIG. 3 and taken generally along line 4—4 positioned below a pickup roller in the printer of FIGS. 1 and 2.

The location of the two pickup rollers 16 from the printer illustrated in FIGS. 1 and 2 are shown in phantom atop the script illustrated in FIG. 3. The script is loaded in the tray upside down for the particular printer illustrated, with the pickup rollers 16 frictionally engaging the back side of the liner 20 as illustrated in FIG. 4. One pickup roller 16 engages the liner at the leading edge of a first one of the narrow labels 30 as illustrated in FIG. 3, with the other pickup roller 16 engaging the liner near the leading edge of one of the wide labels 32. Even though the pickup rollers 16 engage the continuous liner 20 for launching the script on its passage through the printer, delamination at the underlying feed strip adjacent one of the narrow strips occurred during testing.

To solve this problem, the first narrow label 30 illustrated in FIG. 5 directly adjoining the right wide label 32 has a leading edge die cut 36 with at least one interrupting label tie 38 therein for locally joining the narrow label to the feed strip 28. As shown in FIG. 5, the left pickup roller 16 is positioned behind the left wide label 32, whereas the right pickup roller 16 is positioned behind the first narrow label 30 directly adjoining the right wide label 32. Since ties are generally undesirable in the pharmacy script they are preferably not included therein except at limited locations in accordance with the present invention for solving the delamination problem experienced in the printer.

Accordingly, the pair of wide labels 32 have continuous die cuts along their leading edges where they adjoin the feed strip 28, without interruption therein or ties. The outboard edges of the wide labels and their trailing edges are exposed atop the liner 20 for permitting their ready removal without interference.

As shown in FIG. 3, and in more detail in FIG. 5, the four narrow labels 30 have full perimeter die cuts which are continuous, except for the first narrow label 30 behind which the right pickup roller 16 is positioned during feeding. The leading edge die cut 36 of the first narrow label 30 preferably includes a pair of the label ties 38 symmetrically disposed laterally therealong. For the exemplary 12 mm width of the narrow label 30, the individual label ties 38 each have a width therealong of slightly less than about 1 mm.

The vertical die cuts 34 extending along the full lengths of the narrow labels 30 between the adjoining narrow labels and the outboard wide labels 32 permit the individual removal of those labels without restraint by adjoining overlay material. Furthermore, the label ties 38 are sufficiently small for also permitting individual removal of the first narrow label 30 upon severing the ties 38, which readily occurs as the individual label is peeled away from the liner.

As shown in FIG. 5, the overlay preferably also includes a thin forward mid-strip 40 which vertically adjoins the center portion of the feed strip 28, and vertically adjoins the four narrow labels 30 laterally between the outboard wide labels 32. Since the narrow labels 30 are shorter in height than the adjoining wide labels 32, the mid-strip 40 at the top or forward end of the narrow labels permits those labels to be offset vertically between the leading and trailing edges of the outboard wide labels 32.

As shown in FIG. 3, a corresponding narrow, aft mid-strip 42 extends laterally along the trailing edges of the narrow labels 30 and adjoins the outboard wide labels 32, and shares a common trailing edge therewith. The forward and aft mid-strips 40,42 maintain the continuity of the overlay 22 around the narrow labels 30 for maintaining label integrity during the manufacturing and printing processes, and have heights of 3 mm and 6 mm, respectively, for example.

The vertical die cuts 34, and the horizontal die cuts 36 define the perimeters of the several narrow labels 30 and wide labels 32 where they adjoin, as well as where they adjoin the forward mid-strip 40 and the feed strip 28. As shown in FIG. 5, the label ties 38 interconnect the first narrow label 30 and the forward mid-strip 40 for maintaining integrity therebetween during launching of the script through the printer by the pickup roller 16 therebehind.

The forward mid-strip 40 laterally adjoins the left side of the right wide label 32 as illustrated in FIG. 5 at the corresponding vertical die cut 34 thereat. The forward mid-strip 40 itself, and both the wide labels 32 vertically adjoin the feed strip 28 along a common horizontal die cut 36 which extends between the left and right ends of the script. The common die cut 36 includes a plurality of strip ties 44 which are interruptions in the die cut for locally joining together the mid-strip 40 to the feed strip 28.

Like the label ties 38, the strip ties 44 are as narrow as possible and are less than about 1 mm for example to provide local ties between the two strips for preventing premature delamination of the overlay material during travel through the printer. The strip ties 44 are preferably equally spaced apart from each other along the length of the forward mid-strip 40 at about 11 mm, for example. The strip ties 44 ensure integrity of the thin feed strip 28 and the thin forward mid-strip 40 as the label sheet is launched through the printer by the pickup rollers 16. The common die cut along the length of the feed strip 28 is continuous from end to end except for the four exemplary strip ties 44 at the forward mid-strip 40.

The label sheet 12 illustrated in FIG. 3 thusly incorporates a thin feed strip 28 which offsets in the aft direction from the sheet leading edge the several narrow and wide labels 30,32 for maintaining their integrity during handling and traveling through the printer. Since the feed strip 28 is typically not used as a label itself, it is preferably as thin as practical, 5 mm for example, for protecting the leading edges of the wide labels 32 and maintaining integrity of the overlay.

The first narrow label 30 is positioned laterally atop the liner 20 for being in alignment with the corresponding pickup roller 16. And, the label ties 38, as illustrated in FIG. 5, are also aligned with the corresponding pickup roller 16 when the label sheet 12 is loaded into the paper tray, with the label ties 38 interconnecting the feed strip 28 to the first narrow label 30 through the intervening mid-strip 40.

The locally positioned pair of label ties 38 maintain integrity of the first narrow label with the corresponding portion of the forward mid-strip 40. And, the additional strip ties 44 maintain integrity of the thin forward mid-strip 40 with the feed strip. In this way, the thin mid-strip 40 is interconnected with the feed strip 28 along its forward edge, and with the narrow labels 30 along its opposite aft edge, with the corresponding label and strip ties 38,44 providing structural ligaments.

Once the label sheet 12 begins its transport through the printer, the remaining portions of the labels therein are not prone to delamination during travel. Accordingly, but for the selectively positioned label ties 38 and strip ties 44 in the various embodiments disclosed above, the remaining perimeters of the various labels in the script are preferably without any integrating ties therealong.

In the exemplary embodiment illustrated in FIG. 3, a horizontal row of three laterally adjacent aft labels 46 is disposed below the narrow and wide labels and spaced therefrom atop the liner 20. Although the leading edges of these aft labels 46 are exposed without adjoining overlay material, they are nevertheless not prone to delamination upon travel through the printer since they are carried along with the liner being pulled through the printer.

The selectively introduced ties 38,44 cooperating with the forward mid-strip 40 and feed strip 28 in the various embodiments disclosed above ensures integrity of the label sheet 12 as it is transported through the printer, without premature delamination of any of the labels therefrom. Upon complete printing of the various labels on the script, the individual labels may then be separately removed without carrying therealong any of the adjacent labels, or without carrying the feed or mid-strips which remain attached to the liner 20. The first narrow label 30 may be readily removed from the liner by being peeled away therefrom preferably starting from its trailing edge which will readily sever the label ties 38 without otherwise tearing the label itself.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims in which we claim:

What is claimed is:

1. A label sheet for being printed in a printer, comprising:

a release liner having a leading edge for first travelling through said printer; and an overlay adhesively bonded to said liner, and including:

a feed strip extending laterally across said liner adjacent said leading edge thereof;

a narrow label and a wide label disposed laterally along said feed strip at corresponding die cuts permitting individual removal thereof from said liner and from said feed strip;

said narrow label having a leading edge die cut with an interrupting label tie therein for locally joining said narrow label through said overlay to said feed strip; and said wide label having a leading edge die cut without interruption therein.

2. A sheet according to claim 1 wherein said overlay further comprises a plurality of said narrow labels laterally adjoining each other at corresponding die cuts, and only a first one of said narrow labels adjoins said wide label, and includes said label tie.

3. A sheet according to claim 2 wherein said overlay further comprises a mid-strip adjoining said feed strip and said plurality of narrow labels at corresponding die cuts, and said label tie interconnects said first narrow label and said mid-strip.

4. A sheet according to claim 3 wherein said mid-strip laterally adjoins said wide label at a die cut thereat, and both said mid-strip and wide label adjoin said feed strip along a common die cut, and said common die cut includes a plurality of strip ties therein for locally joining said mid-strip to said feed strip.

5. A sheet according to claim 4 wherein said strip ties are equally spaced apart along said mid-strip.

6. A sheet according to claim 4 further comprising a pair of said label ties symmetrically disposed along said die cut leading edge of said first narrow label.

7. A sheet according to claim 6 wherein said strip ties are equally spaced apart along said mid-strip.

8. A sheet according to claim 7 further comprising a pair of said wide labels straddling said narrow labels laterally along said feed strip, and said common die cut extends continuously along said feed strip except for said strip ties therein.

9. A method of preventing delamination of said first narrow label from said liner as said sheet according to claim 2 is launched through said printer by a pickup roller thereof, comprising:

positioning said first narrow label laterally atop said liner in alignment with said roller; and aligning said label tie with said roller for interconnecting said feed strip with said first narrow label.

10. A method of preventing delamination of said first narrow label from said liner as said sheet according to claim 3 is launched through said printer by a pickup roller thereof, comprising:

positioning said first narrow label laterally atop said liner in alignment with said roller; and aligning said label tie with said roller for interconnecting said mid-strip with said first narrow label.

11. A method of preventing delamination of said first narrow label from said liner as said sheet according to claim 4 is launched through said printer by a pickup roller thereof, comprising:

positioning said first narrow label laterally atop said liner in alignment with said roller; and aligning said label tie with said roller for interconnecting said mid-strip with said first narrow label.

12. A method of preventing delamination of said first narrow label from said liner as said sheet according to claim 6 is launched through said printer by a pickup roller thereof, comprising:

positioning said first narrow label laterally atop said liner in alignment with said roller; and aligning said label tie pair with said roller for interconnecting said mid-strip with said first narrow label.

* * * * *